United States Patent [19]

Holland et al.

[11] Patent Number: 4,519,457

[45] Date of Patent: May 28, 1985

[54] OIL WELL STANDING VALVE

[75] Inventors: Ronald A. Holland, Newport Beach; Harold L. Petrie, Sierra Madre; John R. Brennan; Frederick C. Christ, both of Long Beach, all of Calif.

[73] Assignee: Armco Inc., Middletown, Ohio

[21] Appl. No.: 580,684

[22] Filed: Feb. 16, 1984

[51] Int. Cl.[3] ..... E21B 34/14

[52] U.S. Cl. ..... 166/317; 166/332

[58] Field of Search ..... 166/317, 332, 334, 325, 166/327, 322, 321, 316, 188, 133; 417/434

[56] References Cited

U.S. PATENT DOCUMENTS

| | | | |
|---|---|---|---|
| 1,644,998 | 10/1927 | Gunn et al. | 417/434 X |
| 1,956,112 | 4/1934 | Willoughby | 103/221 |
| 2,131,299 | 9/1938 | Reagin | 103/221 |
| 2,604,169 | 7/1952 | Miller | 166/332 |
| 2,752,861 | 7/1956 | Hill | 103/221 |
| 2,854,929 | 10/1958 | McGowen, Jr. et al. | 103/221 |
| 2,885,006 | 5/1959 | Long et al. | 166/332 |
| 2,994,280 | 8/1961 | Daffin | 103/229 |
| 3,954,138 | 5/1976 | Miffre | 166/188 |
| 4,237,980 | 12/1980 | Robinson | 166/317 |
| 4,364,407 | 12/1982 | Hilliard | 166/317 X |

*Primary Examiner*—James A. Leppink
*Assistant Examiner*—Hoang C. Dang
*Attorney, Agent, or Firm*—Frost & Jacobs

[57] ABSTRACT

A standing valve which may be retrievably mounted in a well production tubing and will allow the maximum possible fluid flow and also allow the valve to be easily drained and retrieved through the well production tubing. The seal between the standing valve and the bottom hole assembly is located at or below the level of the seat and fluid from the top of the valve into the well is drained through the seat.

10 Claims, 4 Drawing Figures

OIL WELL STANDING VALVE

BACKGROUND OF THE INVENTION

1. Background of the Invention

This invention relates to improvements in oil well pumping apparatus and more particularly to improvements in standing valves of the type commonly employed at the bottom of an oil well for allowing production fluid to pass freely upwardly and for closing against undesirable backflow.

2. Description of the Prior Art

In oil wells, a string of tubing extends downwardly to the well casing and oil is pumped out of the well through the tubing by means of a pump located adjacent the bottom of the well. The pump normally includes a foot or check valve or other equivalent valve means to prevent unintentional flow of liquid downwardly through the tubing so that in the event that the pump is stopped for any reason, the fluid head of liquid in the tubing will not be lost. Frequently, however, it is desired for various reasons to interrupt the production of a well in order to remove the pump and the entire string of tubing from the well. In such circumstances, unless the head of liquid can first be drained or otherwise removed from the tubing, it becomes necessary to remove the tubing while the latter is filled with liquid. For this reason, it is accepted practice to provide a means of draining the tubing with tools run into the well on a wire line, or otherwise opening ports to drain the fluid from the tubing back into the well bore. The standing valve may then be retrived with the wire line without the added load of unseating against the head of liquid in the tubing. The load of an upstanding column of production fluid, which may be of considerable weight and height above the valve, causes undue strain on and breakage of any of the wire line, the clutching connection, the valve unit, and the production string.

The prior art has long been concerned with improvements in oil well standing valves. Exemplary of the patents in this area include U.S. Pat. Nos. 2,854,929, in the name of Harold E. McGowen, Jr., et al.; 2,752,861, in the name of Robert H. Hill; 1,956,112, in the name of Wayne W. Willoughby; and 1,644,998, in the name of Robert W. Gunn, et al. However, prior art standing valves have been unsuccessful because they do not allow the maximum possible fluid flow from the well and also still allow the valve to be easily drained and retrieved through the tubing.

Furthermore, standing valves commonly use flow of all produced fluids around a poppet or ball, but within the standing valve body, greatly reducing the flow area of the seat. Such structure does not allow for maximum possible fluid flow.

SUMMARY OF THE INVENTION

The present invention provides a standing valve to be retrievably mounted in a well production tubing which will allow the maximum possible fluid flow and also still allow the valve to be easily drained and retrieved through the well production tubing. The standing valve includes a valve body having a passage therethrough and at least one port extending from the passage to the outside body. Sealing means are provided on the outside of the body below the port for sealing engagement with the production tubing in the mounting position of the standing valve. A valve seat is provided in the passage of the valve body between the outlet port and the sealing means. A one-way valve is associated with the valve seat and acts against downward fluid flow. The one-way valve comprises a stem and head, the head having a central aperture therethrough and the lower end of the stem being located in and in sealing engagement with the central aperture and being maintained therein by a break-away device to release when subjected to predetermined force.

A puller assembly engagable by a pulling tool is captively mounted in the upper portion of the valve body and engagable with the stem to apply a pulling force thereto and pull the stem upwardly. In operation, if a pulling force applied to the puller assembly, and thus to the stem, does not retrieve the standing valve, then the break-away device will release and the stem will disengage and expose the central aperture in the one-way valve head, permitting continued draining of well fluid above the standing valve, and additional force on the puller assembly will remove the standing valve because of the captive mounting of the puller assembly in the valve body.

In a preferred embodiment, the puller assembly may comprise a cylindrical fishing neck having an axial bore extending therethrough. A cylindrical stop is threadedly engaged on the exterior of the lower end of the fishing neck, and a ring stop, having an internal diameter less than the diameter of the fishing neck bore, is clamped between the lower end of the fishing neck and the cylindrical stop.

The valve body is provided with a first annular shoulder above the outlet port and engagable by the cylindrical stop, and with a second annular shoulder at its upper end, also engagable by the cylindrical stop. The first and second shoulders determine the vertical travel of the puller assembly within the valve body. The valve stem extends with the fishing neck bore through the ring stop and has an external diameter less than the internal diameter of the ring stop. Finally, the valve stem terminates at is upper end in a headed portion having an external diameter less than the diameter of the fishing neck bore and greater than the internal diameter of the ring stop.

The retrievable, standing valve of the present invention provides for an extremely high volume flow. This is accomplished because the maximum fluid flow area is achieved by diverting the flow out into the bottom hole assembly immediately after passing through the valve. This results because the seal between the standing valve and the bottom hole assembly is located at or below the level of the seat. With the seal below the level of the seat, the draining of the fluid off the top of the standing valve before it is pulled from the well may be easily accomplished, since the fluid from the top of the valve, for maximum fluid flow, drains through the seat.

DESCRIPTION OF THE PREFERRED EMBODIMENT

Figure 1:
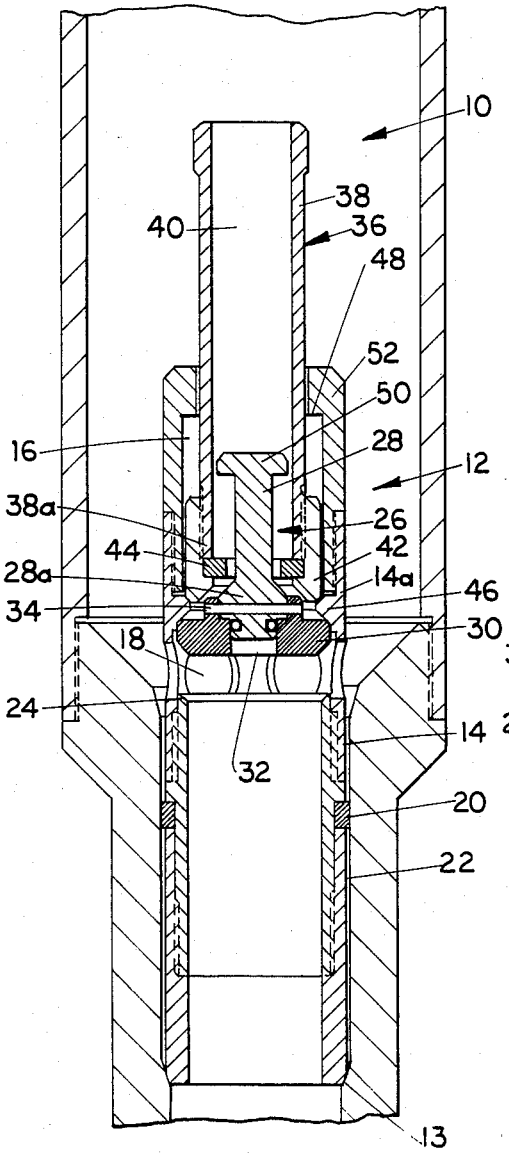
FIG. 1 is a cross sectional view through the standing valve when it is in the open position.

Referring to the drawings, a fragment 10 of a bottom hole assembly and tubing system incorporating the high volume, retrievable, standing valve 12 of the present invention is shown. As is well known, a standing valve prohibits fluid from flowing from the bottom hole assembly to the well during shut down or retrieval of a hydraulic-free pump. A standing valve and bottom hole assembly design which will allow the maximum possible fluid flow and also still allow the valve to be easily drained and retrieved from the tubing, has long escaped prior art inventors.

It has been determined that the maximum fluid flow area through a retrievable standing valve and bottom hole assembly can be achieved by diverting the flow of fluid out into the bottom hole assembly immediately after passing through the valve seat. This requires that the seat between the standing valve and the bottom hole assembly be located at or below the level of the seat. As previously indicated, it is advantageous and sometimes necessary to drain the fluid off the top of the standing valve before it is pulled from the well. With the seal below the level of the seat, the fluid from the top of the valve must pass by the seat before it can drain back into the well. If passages are provided around the outside of the seat, as is commonly done in the prior art, the flow area of the seat is greatly reduced. Accordingly, for maximum fluid flow, the fluid must drain through the seat. The standing valve 12 of the present invention provides a unique way of draining the fluid from the top of the valve into the well through the seat.

In practice, the entire bottom hole assembly, which includes the valve cavity 11, is attached fluid-tight at both ends to the tubing string 10. The standing valve 12, which is limited in its downward travel within the bottom hole assembly by the no-go 13, includes a valve body 14 having a passage 16 therethrough and at least one port 18 extending from the passage 16 to the outside body. The valve body 14 rests in the bottom hole assembly and sealing means 20 on the outside of the body 14 at or below the port 18 is in sealing engagement with the production tubing 10 in the mounting position of the standing valve 12.

A seat 24 is provided above the seal 20 between the ports 18 and the seal 20. A one-way valve 26 is associated with the seat 24 and acts against downward fluid flow. The one-way valve 26 may be any type of check valve which prevents flow of fluid from the bottom hole assembly to the well but preferably includes a poppet-type valve having a stem 28 and head 30. The head 30 is provided with a central apeture 32 therethrough, and the lower end **28*a* of the stem 28 is located in and in sealing engagement with the central aperture 32 and maintained therein by a break-away device 34 which releases when subject to a predetermined force. In practice, the break-away device 34** typically comprises a shear pin, but similar acceptable break-away devices include a reduced section of metal or concentric sleeves with friction restraint.

The valve 12 of the present invention represents a significant improvement over existing standing valves for use where high flow rates are encountered.

It has been found that for high velocity flow rates, a one-way valve 26 comprising a poppet having a stem 28 and head 30 is better than a ball. This is so because a ball will tend to be unstable and damage its retaining cage. Additionally, the break-away device 34 and its release mechanism for drain back is convenient to build into a poppet-type valve.

A puller assembly 36, engagable by a well pulling tool (not shown), is captively mounted in the upper portion **14*a* of the valve body 14 and engagable with the stem 28 to apply a pulling force thereto and pull the stem 28 upwardly. If a pulling force applied to the puller assembly 36 by a pulling tool, and thus to the stem 28, does not retrieve the standing valve 12, then the break-away device 34 will release and the stem 28 will disengage and expose the central aperture 32 in the head 30, permitting continued draining of well fluid above the standing valve 12, and additional force on the puller assembly 36 will remove the standing valve 12 because of the captive mounting of the puller assembly 36 in the valve body 14**.

In practice, the puller assembly 36 comprises a cylindrical fishing neck 38 having an axial bore 40 extending therethrough. A cylindrical stop 42 is threadedly engaged on the exterior of the lower end **38*a* of the fishing neck 38 and a ring stop 44, which preferably comprises split rings, is clamped between the lower end 38*a* of the fishing neck 38 and the cylindrical stop 42. The ring stop 44 is provided with an internal diameter less than the diameter of the fishing neck bore 40**.

The valve body 14 is provided with first and second annular shoulders 46 and 48 which determine the vertical travel of the puller assembly 36 within the valve body 14. The first annular shoulder 46 is located above the outlet ports 18 and the second annular shoulder 48 is located at the upper end **14*a* of the valve body 14**.

As can be seen, the valve stem 28 extends with the fishing neck bore 40 through the ring stop 44. The valve stem 28 is of an external diameter less than the internal diameter of the ring stop 44 and terminates at its upper end in a headed portion 50 having an external diameter less than the diameter of the fishing neck bore 40 and greater than the internal diameter of the ring stop 44. Finally, the upper portion **14*a* of the valve body 14 may comprise a removable valve cap 52 to more easily accommodate the puller assembly 36 in the valve body 14**.

It will be seen that in operation, the head 30 of the one-way valve 26 moves between a one-way valve closed position in sealing engagement against the seat 24 and a fully open position against the first annular shoulder 46.

Figure 2:
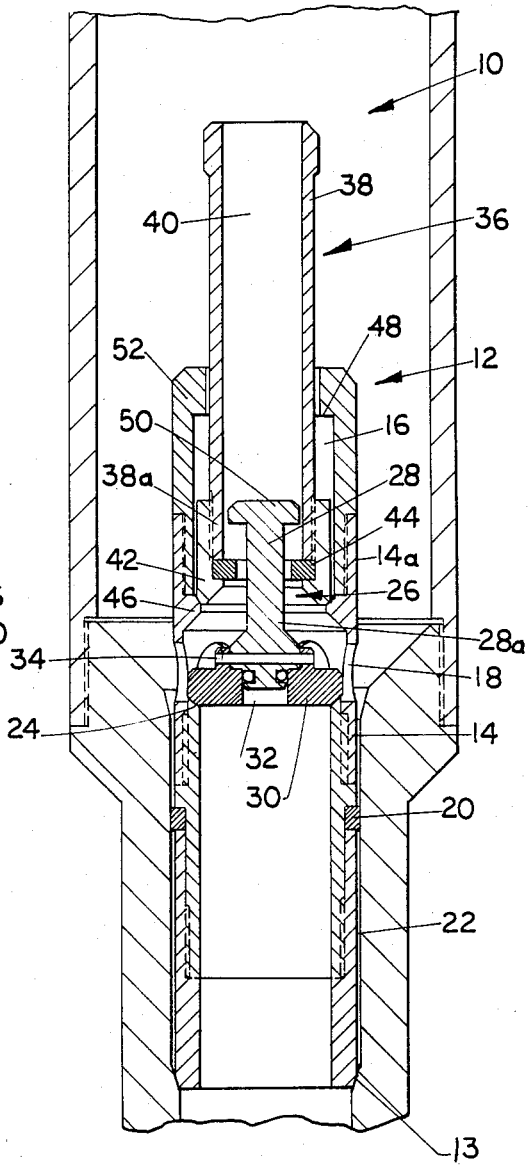
FIG. 2 is a cross sectional view through the standing valve when it is in the closed position.

When the head 30 of the one-way valve 26 is seated against the seat 24, fluid cannot pass through the tubing string 10 into the well, as shown in FIG. 2. However, when the pump (not shown), located above the valve 12, lowers the pressure on the one-way valve 26 to less than the pressure in the well, the one-way valve 26 opens, as shown in FIG. 1, and the production fluid flows out of the well and around the valve 12 through the ports 18 in the valve body 14.

Figure 3:
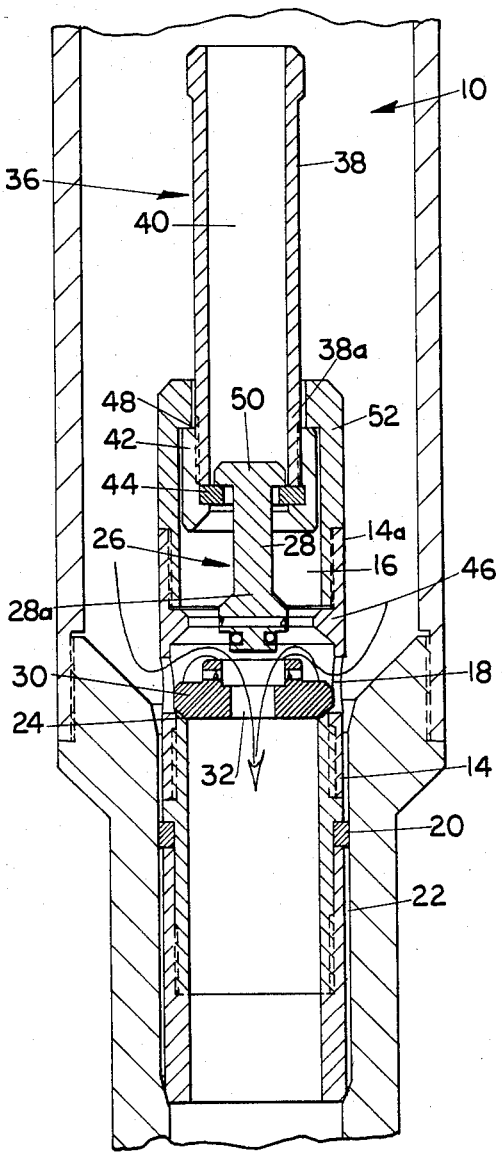
FIG. 3 is a cross sectional view through the standing valve during retrieval of the valve when the break-away device releases.
Figure 4:
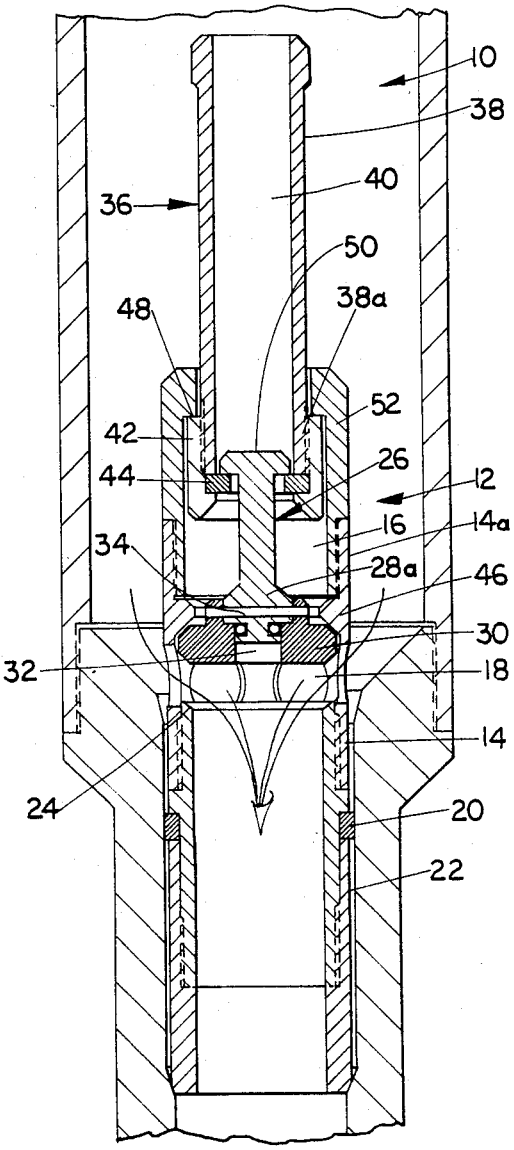
FIG. 4 is a cross sectional view through the standing valve during retrieval thereof when the break-away device does not release.

As previously pointed out, it is advantageous and sometimes necessary to drain the fluid off the top of the standing valve 12 before it is pulled from the well, in which case a commonly used "fishing" tool (not shown) may be hooked over the fishing neck 38. An upward force applied to the neck 38 will be transmitted to the stem 28 of the one-way valve 26 through the cylindrical stop 42 and ring stop 44. This will either lift the head 30 of the one-way valve 26 off the seat 24, as shown in FIG. 4, or if the pressure on the one-way valve 26 is great enough, it will cause the break-away device 34 to release and the lower end **28*a* of the stem 28 is caused to pull out of the head 30 and expose the central aperture 32, as shown in FIG. 3, permitting continued draining of well fluid above the standing valve 12. It should be emphasized that if the weight of the well fluid column above the standing valve 12 does not cause the break-away device 34 to release, the entire one-way valve 26, including the stem 28 and head 30, will be pulled upwardly. Either way will drain the fluid from the tubing 10** into the well.

If it is then desirable to pull the valve 12 out of the tubing 10, continued upward force on the fishing neck 38 will cause the cylindrical stop 42 to travel upwardly until it contacts the second annular shoulder 48 on the valve cap 52 and pulls the valve 12 out of the cavity 22. If the break-away device 34 is not released when the valve 12 is drained, it will not release when the valve 12 is pulled out of the cavity 22 because the cylindrical stop 42 will hit the second annular shoulder 48 before the head 30 hits the first annular stop or shoulder 46.

During operation of the pump, the standing valve 12 will be open, as best seen in FIG. 1, and the puller assembly 36, including the fishing neck 38, cylindrical stop 42 and ring stop 44, will be against the second annular shoulder 48 in the lowest position, because the one-way valve 26, even in the fully open position, does not interfere with the puller assembly 36. This means that if the puller assembly 36 should somehow become stuck in the valve cap 52, it will not interfere with the opening or closing operation of the one-way valve 26.

The standing valve 12 of the present invention prohibits fluid from flowing from the bottom hole assembly to the well during shut down or retrieval of the hydraulic free pump, but it allows the maximum possible fluid flow during operation and provides a unique way of draining the fluid from the top of the valve into the well through the seat 24. The standing valve 12 has much greater flow area for produced well fluids than existing prior art valves, permitting high rate production. Placing the valve seat 24 above the seal 20 permits flow of well production fluid outside the valve body 14 of the standing valve 12. This construction results in a much greater flow area, a significant restriction on present standing valves. In many retrieval operations, the break-away device 34 will not be damaged and the standing valve assembly may be reused after proper inspection.

What is claimed is:

1. In a standing valve to be retrievably mounted in a well production tubing which will allow the maximum possible fluid flow and also still allow the valve to be easily drained and retrieved through the well production tubing:

(a) a valve body having a passage therethrough and at least one port extending from the passage to the outside body;

(b) sealing means on the outside of said body below said port for sealing engagement with said production tubing in the mounting position of said standing valve;

(c) a seat in said passage of said valve body between said port and said sealing means;

(d) a one-way valve associated with said seat and acting against downward fluid flow, said one-way valve comprising a stem and head, said head having a central aperture therethrough and the lower end of said stem being located in and in sealing engagement with said central aperture and being maintained therein by a break-away device to release when subjected to a predetermined force; and (e) a puller assembly engagable by a pulling tool and captively mounted in the upper portion of said valve body and engagable with said stem to apply a pulling force thereto and pull said stem upwardly;

whereby if a pulling force applied to said puller assembly, and thus to said stem, does not retrieve said standing valve, then said break-away device will release and said stem will disengage and expose said central aperture in said head, permitting continued draining of well fluid above said standing valve, and additional force on said puller assembly will remove said standing valve because of the captive mounting of said puller assembly in said valve body.

2. The standing valve according to claim 1, wherein said puller assembly comprises a cylindrical fishing neck having an axial bore extending therethrough, a cylindrical stop threadedly engaged on the exterior of the lower end of said fishing neck, a ring stop clamped between the lower end of said fishing neck and said cylindrical stop, said ring stop having an internal diameter less than the diameter of said fishing neck bore, said valve body having a first annular shoulder above said outlet port and engagable by said cylindrical stop, said valve body having a second annular shoulder at its upper end engagable by said cylindrical stop, said first and second shoulders determining the vertical travel of said puller assembly within said valve body, said valve stem extending with said fishing neck bore through said ring stop, said valve stem having an external diameter less than the internal diameter of said ring stop, said valve stem terminating at its upper end in a headed portion having an external diameter less than the diameter of said fishing neck bore and greater than the internal diameter of said ring stop.

3. The standing valve according to claim 2, wherein said head moves between a one-way valve closed position in sealing engagement against said seat and a fully open position against said first annular stop.

4. The valve according to claim 2, wherein the upper portion of said valve body comprises a removable valve cap.

5. The standing valve according to claim 1, wherein said break-away device comprises a shear pin.

6. Valve means for an oil well apparatus of the type having an outer casing, tubing within the casing and defining an annular space therebetween, and a pump for withdrawing oil through the tubing, said valve means comprising:

(a) a valve body having a passage therethrough and at least one port extending from the passage to the outside of the body;

(b) sealing means on the outside of said body below said port for sealing engagement with said production tubing in the mounted position of said valve means;

(c) a seat in said passage of said valve body between said port and said sealing means;

(d) a one-way valve associated with said seat and acting against downward fluid flow, said valve comprising a stem and head, said head having a central aperture therethrough and the lower end of said stem being located in and in sealing engagement with said central aperture and being maintained therein by a break-away device to release when subjected to a predetermined force; and (e) a puller assembly engagable by a pulling tool and captively mounted in the upper portion of said valve body and engagable with said stem to apply a pulling force thereto and pull said stem and valve means upwardly;

whereby if a pulling force applied to said puller assembly, and thus to said stem, does not retrieve said valve means, then said break-away device will release and said stem will disengage and expose said central aperture in said head, permitting continued draining of well fluid above said valve means, and additional force on said puller assembly will remove said valve means because of the captive mounting of said puller assembly in said valve body.

7. The valve means according to claim 6, wherein said puller assembly comprises a cylindrical fishing neck having an axial bore extending therethrough, a cylindrical stop threadedly engaged in the exterior of the lower end of said fishing neck, a ring stop clamped between the lower end of said fishing neck and said cylindrical stop, said ring stop having an internal diameter less than the diameter of said fishing neck bore, said valve body having a first annular shoulder above said outlet port and engagable by said cylindrical stop, said valve body having a second annular shoulder at its upper end engagable by said cylindrical stop, said first and second shoulders determining the vertical travel of said puller assembly with said valve body, said valve stem extending with said fishing neck bore through said ring stop, said valve stem having an external diameter less than the internal diameter of said ring stop, said valve stem terminating at its upper end in a headed portion having an external diameter less than the diameter of said fishing neck bore and greater than the diameter of said internal diameter of said ring stop.

8. The valve means according to claim 7, wherein said head moves between a one-way valve closed position in sealing engagement against said seat and a fully open position against said first annular stop.

9. The valve means according to claim 7, wherein said break-away device comprises a shear pin.

10. The valve means according to claim 7, wherein the outer portion of said valve body comprises a removable valve cap.

* * * * *